US005112038A

United States Patent [19]

Dunaway

[11] Patent Number: 5,112,038

[45] Date of Patent: May 12, 1992

[54] FEEDBACK CONTROL FOR RECEIVER MEMBER IN-TRACK REGISTRATION IN AN ELECTROSTATOGRAPHIC REPRODUCTION APPARATUS OR THE LIKE

[75] Inventor: David L. Dunaway, Rochester, N.Y.

[73] Assignee: Eastman Kodak Company, Rochester, N.Y.

[21] Appl. No.: 723,981

[22] Filed: Jul. 1, 1991

[51] Int. Cl.[5] ..... B65H 3/06

[52] U.S. Cl. ..... 271/10; 271/111; 271/227; 271/242; 271/265

[58] Field of Search ..... 271/110, 111, 10, 227, 271/242, 258, 259, 261, 265

[56] References Cited

U.S. PATENT DOCUMENTS

| | | | |
|---|---|---|---|
| 3,575,411 | 4/1971 | Kastelic | 271/50 |
| 3,790,270 | 2/1974 | Donohue | 355/14 |
| 4,342,512 | 8/1982 | Tolmie | 355/14 SH |
| 4,461,465 | 7/1984 | Hartman et al. | 271/22 |
| 4,485,949 | 12/1984 | Gebhart et al. | 226/2 |
| 4,519,700 | 5/1985 | Barker et al. | 355/3 SH |
| 4,621,799 | 11/1986 | Bastow | 271/242 X |
| 4,621,801 | 11/1986 | Sanchez | 271/251 |
| 4,731,637 | 3/1988 | Acquaviva | 271/227 X |
| 4,874,958 | 10/1989 | Sampath et al. | 355/309 |

*Primary Examiner*—Richard A. Schacher

*Attorney, Agent, or Firm*—Lawrence P. Kessler

[57] ABSTRACT

Feedback control for receiver member in-track registration for immediacy of registration error correction and improved long term in-track registration accuracy. In an electrostatographic reproduction apparatus or the like, a receiver member is fed at a preselected time from a supply and transported along a travel path, including a registration mechanism adapted to selectively intercept the travel path. The receiver member is stopped at the intercept position, and a desired dwell time for the receiver member at the intercept position, prior to actuation of the registration mechanism, is established. After expiration of the dwell time, the registration mechanism is actuated to advance the receiver member from the intercept position into association with a marking particle developed image. the receiver member is sensed at a predetermined location downstream of the registration mechanism and a signal indicative thereof is provided. In response to the signal indicative of sensing the receiver member at the downstream location, the time for sensing a receiver member is determined, and such determined time is compared to an absolute reproduction apparatus time expected for sensing of a receiver member. Thereafter, in response to such comparison, feedback is provided to alter the time for actuating the registration mechanism and, based on such altered actuation time, altering starting of the dwell period.

15 Claims, 3 Drawing Sheets

FEEDBACK CONTROL FOR RECEIVER MEMBER IN-TRACK REGISTRATION IN AN ELECTROSTATOGRAPHIC REPRODUCTION APPARATUS OR THE LIKE

BACKGROUND OF THE INVENTION

This invention relates in general to in-track registration control for receiver members in electrostatographic reproduction apparatus or the like, and more particularly to in-track registration control for receiver members employing a feedback loop for immediacy of registration error correction and improved in-track registration accuracy over the long term.

In modern high speed electrostatographic reproduction apparatus, such as copiers and printers or the like, a marking particle developed image corresponding to information to be reproduced is transferred to a receiver member to form a desired reproduction. The receiver member is, for example, a cut sheet of plain bond paper. The receiver member is fed from a supply stack into association with that portion of the electrostatographic reproduction apparatus bearing the marking particle developed image. It is essential that the feed and transport of the receiver member be controlled in such a manner so as to present the receiver member into association with the marking particle developed image within a specified window of time in order to form an acceptable reproduction on the receiver member.

In the operation of electrostatographic apparatus, it is common practice in feeding and transporting receiver members to remove a receiver member from the supply stack at a preselected time, and feed the receiver member, by means of driven nip rollers for example, along a transport path to a registration gate where the member is momentarily stopped. The receiver member is then released by the gate at a specified time so as to be transported therefrom into association with the marking particle developed image in in-track register for aligned transfer of the marking particle image to the receiver member. As shown for example in U.S. Pat. No. 3,575,411 (issued Apr. 20, 1971, in the name of Kastelic), variability in the timing of transport of the receiver member in the in-track direction to the registration gate relative to a given time for a receiver member travel from the supply to the registration gate can be and the transport apparatus effectively controlled to speed up or slow down the receiver member. However, such control looks only at the absolute travel time for the receiver member; it does not take into account tolerances in the feed and transport elements or wear of such elements over time. As a result, no overall adjustment to immediately correct for element errors and improve in-track registration control accuracy over the long term is possible.

SUMMARY OF THE INVENTION

This invention is directed to feedback control for receiver member in-track registration in an electrostatographic reproduction apparatus or the like for immediacy of registration error correction and improved long term in-track registration accuracy. In an electrostatographic reproduction apparatus in which a receiver member is fed from a supply and transported along a travel path into registered association with a marking particle developed image for transfer of such image to such receiver member, a receiver member is fed at a preselected time from the receiver member supply. The fed receiver member is transported along the travel path toward a registration mechanism and stopped at an intercept position established by the registration mechanism. A desired dwell time for the receiver member at the intercept position, prior to actuation of the registration mechanism, is established. After expiration of the dwell time, the registration mechanism is actuated to advance the receiver member from the intercept position into association with a marking particle developed image. The receiver member is sensed at a predetermined location downstream of the registration mechanism and a signal indicative thereof is provided. In response to the signal indicative of sensing the receiver member at the downstream location, the time for sensing a receiver member is determined, and such determined time is compared to an absolute reproduction apparatus time expected for sensing of a receiver member. Thereafter, in response to such comparison, feedback is provided to alter the time for actuating the registration mechanism and, based on such altered actuation time, altering starting of the dwell period.

The invention, and its objects and advantages will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE PREFERRED EMBODIMENT

Figure 1:
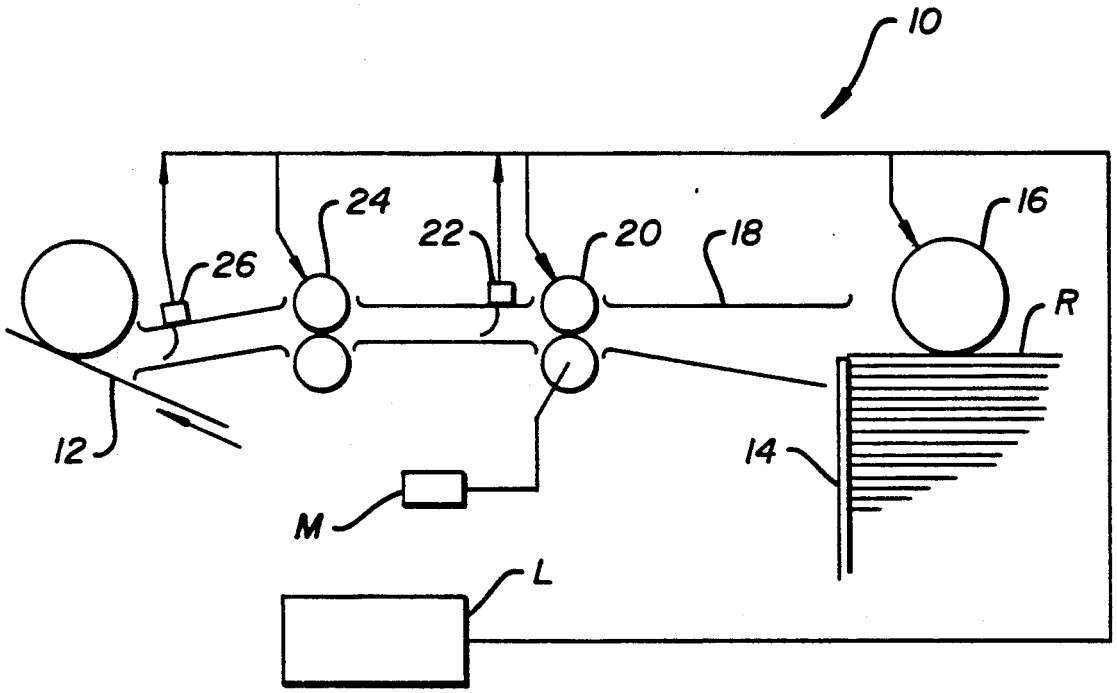
FIG. 1 is a schematic side elevational view of a receiver member handling arrangement including the receiver member in-track registration feedback control according to this invention.

Referring now to the accompanying drawings, FIG. 1 shows a schematic side elevational view of a receiver member handling arrangement, designated generally by the numeral 10, including the receiver member in-track registration feedback control according to this invention. The receiver member handling arrangement 10 is suitable for use with any well known electrostatographic reproduction apparatus, such as a copier or printer or the like, in which a marking particle developed image of information to be reproduced is formed on (carried by) a moving member (e.g., web 12 of FIG. 1) and thereafter transferred to a receiver member to form the desired reproduction.

The receiver member handling arrangement 10 includes a hopper 14 for storing a supply of receiver members R. A feed mechanism 16 is operatively associated with the supply of receiver members in the hopper 14 for feeding receiver members seriatem from the hopper. The feed mechanism 16 is a vacuum feeder or scuff roller assembly, for example, which is clutch controlled. At a desired time on each selective clutch actuation, the topmost receiver member is removed from the supply and fed in a downstream direction into a guide assembly 18. The guide assembly 18 defines a travel path from the supply hopper 14 to the marking particle developed image carrying web 12.

Along the path defined by the guide assembly 18, in progressive order from the supply hopper 14 to the marking particle developed image carrying web 12, is a nip roller pair 20, a first sensor 22, a registration mechanism 24, and a second sensor 26. The clutch controlled nip roller pair 20 is driven by a suitable motor at a known speed to transport a fed receiver member at a predetermined velocity from the supply hopper 14 to the registration mechanism 24. The first sensor 22, located between the nip roller pair 20 and the registration mechanism 24, is provided to detect the lead edge of the transported receiver member to determine an exact location of the receiver member at some instant in time. As the receiver member is transported from the registration mechanism toward association with the web 12, the second sensor 26 is provided to detect the lead edge thereof. A signal indicative of detection of the receiver member lead edge produced by the sensor 22 or sensor 26 is sent to a logic and control system L.

Figure 3:
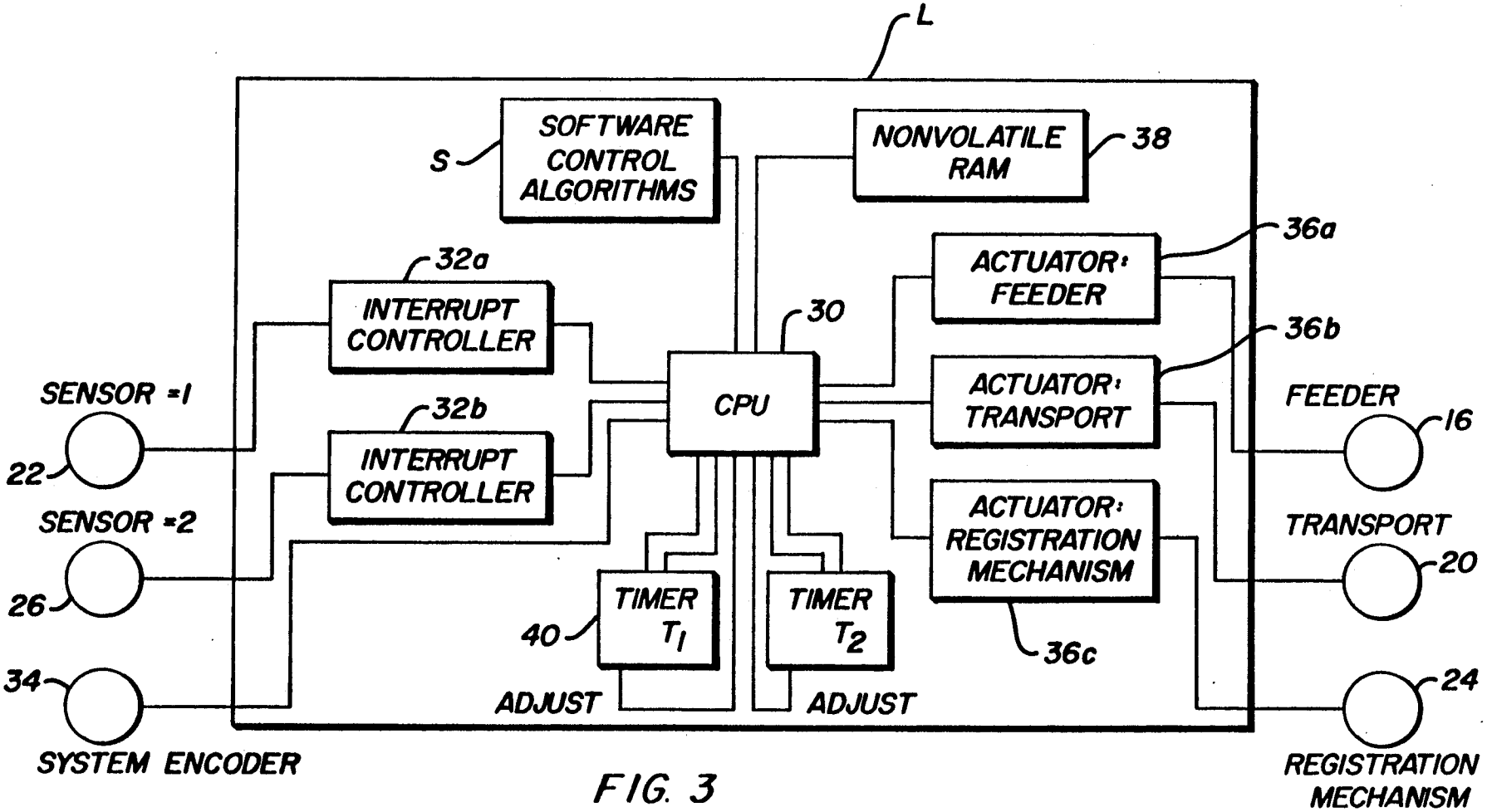
FIG. 3 is a basic circuit diagram for the receiver member in-track registration feedback control according to this invention.

The logic and control system L includes, for example, a microprocessor-based central processing unit 30 receiving various input and timing signals. As shown in FIG. 3, the central processing unit 30 receives input and timing signals from the sensors 22 and 26(through appropriate interrupt controllers 32*a*, 32*b*) and from a primary system encoder 34. Based on such signals and programs supplied by software control algorithms S associated with the central processing unit, the system L produces signals for controlling the operation of the various functions of the reproduction apparatus, including activating/deactivating actuators 36*a*, 36*b*, 36*c* for the receiver member handling arrangement 10 (feed mechanism 16, nip roller pair 20, registration mechanism 24), in order to carry out the reproduction process. The production of suitable programs for a number of commercially available central processing units is a conventional skill well understood in the art. The particular details of any such programs would, of course, depend on the architecture of the designated central processing unit.

Figure 2:
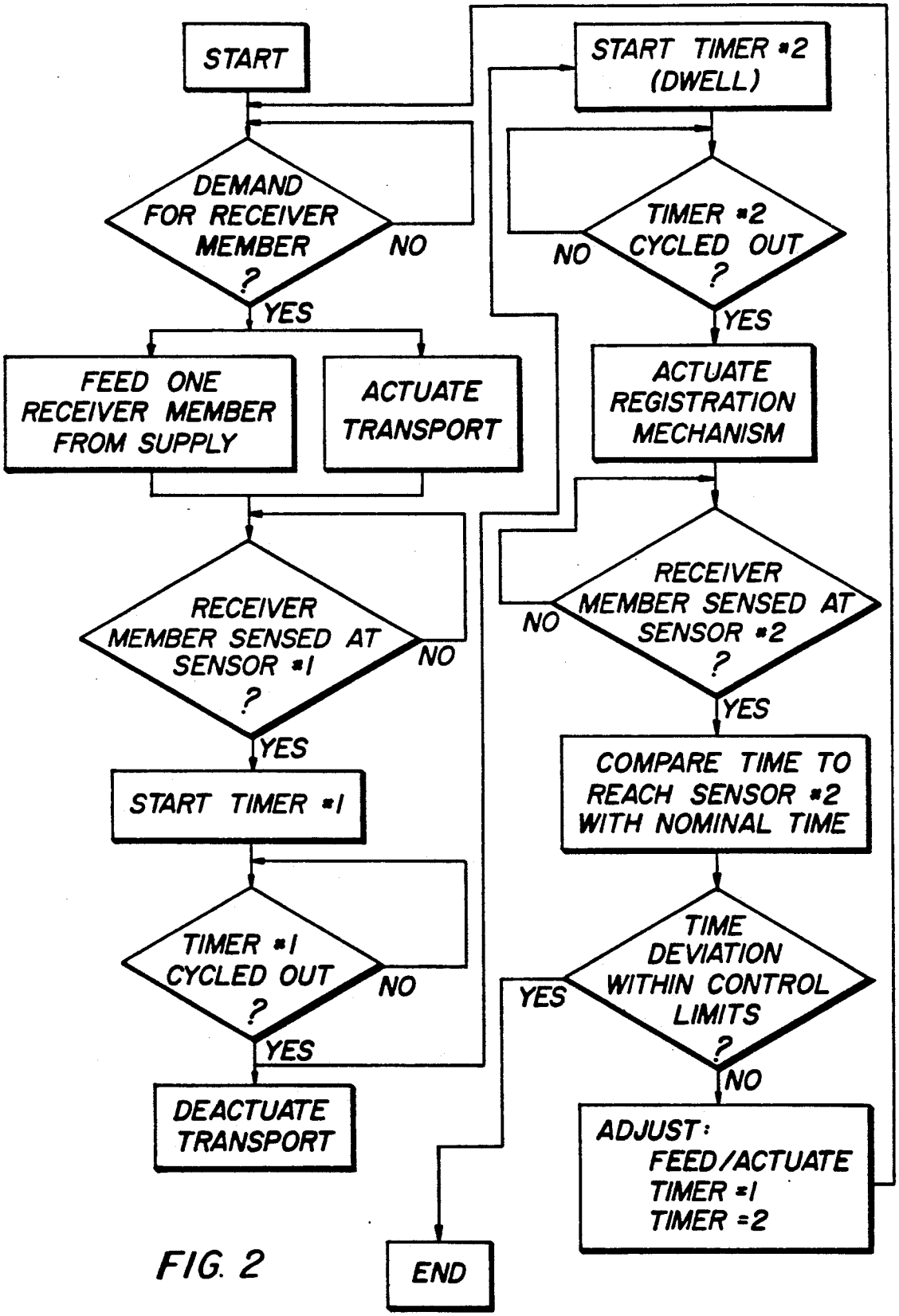
FIG. 2 is a basic timing diagram for accomplishing receiver member in-track registration feedback control according to this invention.

The regulation by the logic and control system L effects receiver member handling and provides for the in-track registration feedback control of this invention in the following manner in accordance with the timing diagram set out in FIG. 2. During the reproduction process when a receiver member is demanded, represented as a time $T_1$ determined by the primary system encoder 34, the feed mechanism 16 is activated to feed one receiver member from the supply hopper 14. At a subsequent time $T_2$ predetermined by the system encoder 34, the nip roller pair 20 is activated to transport the receiver member along the guide assembly 18. When the lead edge of the transported receiver member is detected by the sensor 22 (represented as occurring at time $T_3$), the produced signal from such sensor is utilized to start a timer 40. Cycle out of the timer 40 (represented as time $T_4$), independent of system encoder time, effects deactuation of the drive for the nip roller pair 20. The timer 40 has a period $P_1$ (time $T_4$ minus time $T_3$) set to be substantially equal to the nominal time for the lead edge of a receiver number transported at the given velocity by the nip roller pair 20 to travel from the sensor 22 to the registration mechanism 24, plus a desired overdrive time to assure that the receiver member is registered at the registration mechanism.

The receiver member is held at the registered location at the registration mechanism 24 for a period of time before the registration mechanism is actuated to transport the receiver member into association with the marking particle developed image carrier web 12. This period (represented as period $P_2$) is referred to as the dwell period and is predetermined by the primary system encoder 34. That is, the period $P_2$ is the time from timing out of the timer 40 and the time at which the primary system encoder 34 determines that actuation of the registration mechanism 24 is to occur (represented as time $T_5$ minus time $T_4$). The time for actuation of the registration mechanism 24 (represented as time $T_5$) to assure registration of the marking particle developed image carried by the web 12 with the receiver member for transfer of the image thereto is of course dependent upon the transport velocity imparted to the receiver member by the registration mechanism, the distance the receiver member has to travel from the registration mechanism into association with the web 12, and the approach of the marking particle developed image to the location where transfer of such image to the receiver member is to take place. Working backwards from the time of actuation of the registration mechanism 24, the desired dwell period $P_2$ is ideally equal to one-half the nominal time for a receiver member to travel the distance between successively fed receiver memebers (i.e., the interframe distance).

As noted above, when the receiver member transported from the registration mechanism 24 toward association with the web 12 passes the second sensor 26, the lead edge thereof is detected by such second sensor (represented as occurring at time $T_6$). The location of the sensor 26 is selected so as to be as close as possible to the line of contact between the receiver member and the marking particle developed image carrying web 12. In this manner, the sensor 26 detects the lead edge to determine an exact location of the receiver member, at some instant in time, relative to the web 12. A signal indicative of detection of the receiver member lead edge produced by the sensor 26 is utilized in logic and control system L, by comparison of the time ($T_6$) for receiving such signal to an absolute reproduction apparatus time determined by the primary system encoder 34 (represented as time $T_7$) for a receiver member to travel to the sensor 26. Such comparison is then used to determine if the receiver member was actually transported in the proper time to assure in-track registration with the marking particle developed image on the web 12.

As will be readily appreciated, the detection of the exact location at the respective known instance in time by the sensors 22 and 26 enable actual receiver member transport times to be determined. Such times are of course effected by tolerance build-ups in manufacturing and, over the long term, wear of the transport elements. The time $T_6$ when the sensor 26 detects the lead edge of the receiver member is compared with absolute reproduction apparatus time $T_7$ to assure that the detected time is within acceptable deviation control limits. If the detected time ($T_6$) exceeds the deviation control limits, the time ($T_5$) for actuating the registration mechanism 24 can be adjusted (to a time represented as time $t_5$) according to parameters established by the software control algorithms S by an amount substantially equal to the difference between times $T_7$ and $T_6$ (represented as $+T$). Once the time for actuating the registration mechanism 24 is adjusted (to the time represented as time $t_5$), the time for expiration of the dwell period $P_2$ is correspondingly set.

Working backwards from the expiration of the dwell period, the time $T_1$ for actuating the feed mechanism 16 can be adjusted (represented as time $t_1$) along with the times for actuating the nip roller pair 20 and for starting the timer 40 for period $P_1$. The adjustment of time $T_1$ to time $t_1$ may be equal to the adjustment $+T$ or may be for some other time depending on the characteristics of the transport elements serving to transport the receiver member to the registration mechanism. Such characteristics can be determined for example by the detection of the receiver member by the sensor 22. The purpose of adjustment of the time $T_1$ is to assure that the start of the desired dwell period occurs in time for duration of the period $P_2$ to be for its ideal duration described above.

The adjusted actuation times described above are stored in nonvolatile memory 38 of the control system L so as to be readily recalled on subsequent reproduction apparatus powerup. In this manner, the in-track registration feedback control takes into account reproduction apparatus-to-reproduction apparatus variabilities due to tolerance build-ups in manufacturing and, over the long term, enables accommodation to be made for wear of the elements of the receiver member handling assembly 10.

The invention has been described in detail with particular reference to preferred embodiment thereof, but it will be understood that variations and modifications can be effected within the spirit and scope of the invention.

I claim:

1. In an electrostatographic reproduction apparatus or the like in which receiver members are fed seriatem by feeding means respectively at a predetermined time from a supply and transported along a travel path, including a registration mechanism adapted to selectively intercept said travel path and stop a receiver member at an intercept position established by said registration mechanism, and means for actuating said registration mechanism to advance said receiver member intercepted by said registration mechanism from the intercept position into registered association with a marking particle developed image for transfer of such image to such receiver member, a feedback control comprising:

means for establishing a desired dwell period for said receiver member at the intercept position prior to actuation of said registration mechanism by said actuating means;

means for sensing an advanced receiver member at a predetermined location downstream of said registration mechanism and providing a signal indicative thereof;

means, responsive to said signal from said downstream sensing means, for determining the time from actuation of said registration mechanism to sensing of a receiver member by said downstream sensing means;

means for comparing said determined time from actuation of said registration mechanism to sensing of a receiver member by said downstream sensing means to a preselected absolute time expected for sensing of a receiver member by said downstream sensing means; and means for providing feedback control to said registration mechanism actuating means, in response to such comparison, to alter the actuation time thereof and, based on such altered actuation time, altering the start of such dwell period by said dwell period establishing means to provide for in-track registration error correction and improved long term accuracy of receiver member to marking particle developed image registration.

2. The invention of claim 1 wherein alteration of the start of such dwell period by said feedback providing means is effected by altering said predetermined time for feeding a receiver member from said supply.

3. The invention of claim 1 further including additional sensing means for sensing a receiver member transported along said travel path between said receiver member supply and said registration mechanism, and for providing a signal indicative thereof; and timing means, responsive to said signal from said additional sensing means for setting a time representative of the nominal time for a receiver member to reach the intercept position established by said registration mechanism after sensing by said additional sensing means to transport a receiver member into registered association with said registration mechanism.

4. The invention of claim 3 wherein said signal from said additional sensing means is utilized by said feedback providing means to determine any necessary alternation of said predetermined time for feeding a receiver member from said supply.

5. The invention of claim 3 wherein dwell period established by said dwell period establishing means is started at the expiration of the time set by said timing means.

6. The invention of claim 1 wherein said dwell period established by said dwell period establishing means is substantially equal to one-half the time between receiver members sequentially fed from said supply.

7. A feedback control for a reproduction apparatus or the like including a supply of receiver members and a travel path for receiver members extending from said supply into association with an image for transfer of such image to a receiver member, said feedback control comprising:

means for feeding receiver members seriatem from said supply respectively at a predetermined time along said travel path;

a registration mechanism adapted to selectively intercept said travel path and stop a receiver member at an intercept position established by said registration mechanism;

means for actuating said registration mechanism to advance said receiver member intercepted by said registration mechanism from the intercept position into registered association with said image for transfer of such image to such receiver member;

means for establishing a desired dwell period for said receiver member at the intercept position prior to actuation of said registration mechanism by said actuating means;

means for sensing an advanced receiver member at a predetermined location downstream of said registration mechanism and providing a signal indicative thereof;

means, responsive to said signal from said downstream sensing means, for determining the time from actuation of said registration mechanism to sensing of a receiver member by said downstream sensing means;

means for comparing said determined time from actuation of said registration mechanism to sensing of a receiver member by said downstream sensing means to a preselected absolute time expected for sensing of a receiver member by said downstream sensing means; and means for providing feedback control to said registration mechanism actuating means, in response to such comparison, to alter the actuation time thereof and, based on such altered actuation time, altering the start of such dwell period by said dwell period establishing means to provide for in-track registration error correction and improved long term accuracy of receiver member to marking particle developed image registration.

8. The invention of claim 7 wherein alteration of the start of such dwell period by said feedback providing means is effected by altering said predetermined time for feeding a receiver member from said supply.

9. The invention of claim 7 further including additional sensing means for sensing a receiver member transported along said travel path between said receiver member supply and said registration mechanism, and for providing a signal indicative thereof; and timing means, responsive to said signal from said additional sensing means for setting a time representative of the nominal time for a receiver member to reach the intercept position established by said registration mechanism after sensing by said additional sensing means to transport a receiver member into registered association with said registration mechanism, the dwell period established by said dwell period establishing means is started at the expiration of the time set by said timing means.

10. The invention of claim 7 wherein said dwell period established by said dwell period establishing means is substantially equal to one-half the time between receiver members sequentially fed from said supply.

11. In an electrostatographic reproduction apparatus or the like in which receiver members are fed seriatem from a supply and transported along a travel path, including a registration mechanism adapted to selectively intercept said travel path, into registered association with a marking particle developed image for transfer of such image to such receiver member, a method for providing feedback control for in-track registration error correction and improved long term accuracy of receiver member to marking particle developed image registration, said feedback control method comprising the steps of:

feeding a receiver member at a preselected time from said receiver member supply;

transporting said fed receiver member along said travel path toward said registration mechanism and stopping the receiver member at an intercept position established by said registration mechanism;

establishing a desired dwell period for said receiver member at the intercept position established by said registration mechanism prior to actuation of said registration mechanism;

after expiration of said dwell period. actuating said registration mechanism to advance said receiver member from the intercept position into association with a marking particle developed image;

sensing said advanced receiver member at a predetermined location downstream of said registration mechanism and providing a signal indicative thereof;

in response to said signal indicative of sensing of said advanced receiver member at said downstream location, determining the time from actuation of said registration mechanism to downstream sensing of such receiver member;

comparing such determined time from actuation of said registration mechanism to downstream sensing of such receiver member to a preselected absolute time expected for sensing of a receiver member; and providing, in response to such comparison, feedback control to alter the time for actuating the registration mechanism and, based on such altered actuation time, altering the start of said dwell period.

12. The invention of claim 11 wherein said dwell period is established to be substantially equal to one-half the time between receiver members sequentially fed from said supply.

13. The invention of claim 11 further including the steps of sensing a receiver member in said travel path between said receiver member supply and said registration mechanism and providing a signal indicative thereof; and, in response to said signal indicative of sensing of such receiver member between said receiver member supply and said registration mechanism, setting a period representative of the nominal time for a receiver member to reach the intercept position established by said registration mechanism after such sensing of such receiver member.

14. The invention of claim 13 wherein said signal indicative of sensing a receiver member in said travel path between said receiver member supply and said registration mechanism is utilized, in providing feedback, to determine any necessary alteration of said predetermined time for feeding a receiver member from said supply.

15. The invention of claim 13 wherein said established dwell period is started at the expiration of the period set to be representative of the nominal time for a receiver member to reach the intercept position established by said registration mechanism after such sensing of such receiver member.

* * * * *